United States Patent [19]

Lepisto

[11] 4,316,574

[45] Feb. 23, 1982

[54] SLEEVE VALVE FOR FLEXIBLE BAGS

[75] Inventor: J. George Lepisto, Middletown, Ohio

[73] Assignee: Champion International Corporation, Stamford, Conn.

[21] Appl. No.: 137,247

[22] Filed: Apr. 4, 1980

[51] Int. Cl.[3] ..... B65D 31/14

[52] U.S. Cl. ..... 229/62.5

[58] Field of Search ..... 229/62.5, 65; 150/9

[56] References Cited

U.S. PATENT DOCUMENTS 3,894,682 7/1975 Harmsen ..... 229/62.5

4,091,986 5/1978 Elerle ..... 229/62.5

*Primary Examiner*—George T. Hall

*Attorney, Agent, or Firm*—Evelyn M. Sommer

[57] ABSTRACT

A flexible paper bag suited for containing granular products includes an improved valve in a corner of one end thereof which is adapted to receive a filler spout of a product dispensing machine therein. The valve comprises a tubular plastic sleeve interposed in an opening between opposing, hinged bottom flaps of the bag. The bottom flaps shift about their hinges toward each other under weight of product within the bag to collapse the sides of the sleeve valve, thereby closing the latter. One extremity of the sleeve valve, which extends into and is freely suspended within the bag, acts as a self sealing valve while the bag is being filled. Shifting of the product within the bag after filling thereof folds the sleeve over onto itself, thereby positively closing the sleeve valve.

11 Claims, 7 Drawing Figures

SLEEVE VALVE FOR FLEXIBLE BAGS

TECHNICAL FIELD

The present invention relates generally to the packaging art, and deals more particularly with a flexible bag suitable for storing fine powdery materials, small sized particle and granular products therein, and of the type provided with a self closing sleeve valve to allow filling the bag with product.

BACKGROUND ART

Heavy weight paper bags are frequently employed for containing, storing and shipping flowable, fine powdery materials and small sized granular products, such as starch, food products, chemicals, cement and the like. By virtue of the flowable character of these products, such bags are filled by inserting a filler spout of a dispensing machine into an opening of the bag, and the product is delivered from a source thereof through the spout into the bag. Many types of the products packaged in this manner may contain dust, or are themselves "dusty" and are easily suspended in the air during movement of the product, as during filling of the bag.

Because dusty portions of the products are easily suspended within the air, filling operations are sometimes messy, and can even present a health hazard to personnel due to the ambient air being polluted by the product. In addition when the filled bags are being transported, the vibrations of the carrier, truck, train and the like cause the fine powdery material to sift out through the filler opening part of the bag. Consequently, attempts to prevent sifting the bags' contents through the valve have been made and special valves have been devised in the past to tightly fasten the filler openings of the bag to the dispensing spout, which valves are adapted to substantially prevent the escape of product from the bag once the dispensing spout is removed from the filler opening. In order to increase production efficiency, these prior art filler valves have been adapted to automatically seal the filler opening after the filling process has been completed.

Prior art bags of the type mentioned above comprise a tubular paper bag closed at both ends, at least one end having a plurality of flaps folded over to define a passageway in the end of the bag which presents an opening at one corner thereof. The bottom flaps are hingedly interconnected to permit the bag to be folded into a flat condition, wherein the walls defining the passageway collapse into face to face, abutting relationship. A flexible, tubularly shaped sleeve, formed from one mil low density polyethylene is secured within the passageway and is coextensive with the latter. The entire length of the sleeve is secured to, and between, the bottom flaps. The sleeve may be secured to a backing panel which is interposed between opposing bottom panels of the bag. The dispenser spout is inserted into the sleeve forming the valve and product is dispensed into the bag. After the bag is filled, the weight of the product in the bag presses downwardly against one of the bottom flaps which squeezes the sleeve between opposing flaps, thereby closing the sleeve and, thus the valve.

The primary problem associated with the prior art bags of the type described above is related to the fact that the sleeve valve used in such bags was not "sift-proof" with respect to the product; i.e. the fine powdery material and small sized product within the bag had a tendency to sift out around and through the sleeve, thereby escaping from the bag. This was due in part to the fact that wrinkles in the sides of the plastic sleeve were created by the filling operation. These wrinkles formed channels on both sides of the walls of the sleeve through which the product could escape.

Accordingly, it is an important object of the present invention to provide an improved valve for flexible bags which is automatically closable and permits filling of the bag with product, but which eliminates the problem of sifting of the product through the sleeve after the bag is filled.

As a corollary to the foregoing object, a further object of the present invention is to provide an improved sleeve valve which eliminates the problem of wrinkling in the material forming the sleeve valve during the filling operation.

Another object of the invention is to provide a sleeve valve which automatically folds against itself after the filling operation is complete in order to positively close the filler passageway through the valve.

A still further object of the invention is to provide an improved valve for flexible bags of the type described above wherein the flexible sleeve is securely held on the bag and is prevented from pulling away therefrom during the filling operation.

SUMMARY OF THE INVENTION

According to the present invention a flexible bag suited for containing fine powdery materials and small sized granular products such as food products, i.e., sugar, flour, chemicals, cement or the like includes an improved sleeve valve in a corner of one end thereof which is adapted to receive a filler spout of a product dispensing machine therewithin. The valve comprises a tubular plastic sleeve preferably made of 0.5 mil high density polyethylene which is adhered to one side of a backing panel. The bag includes a plurality of overlapping bottom flaps providing a passageway which defines the valve. The sleeve valve having the backing panel secured thereto is interposed between opposing sets of the bottom panels within the passageway. One extremity of the sleeve valve extends into the interior of the bag and is freely suspended therewithin, while the opposite extremity of the sleeve valve is secured in air tight relationship to the opposing bottom flaps. The bottom flaps are provided with hinge forming fold lines which permit the bag to be collapsed into an essentially flat condition. The free, suspended end of the plastic sleeve acts as a self-sealing valve when the bag is being filled to eliminate or at least minimize the escape of dusty product from the bag during filling process. The bag is tilted after the filling process such that the product within the bag is induced by gravity to shift toward the corner of the bag opposite the corner in which the valve is disposed. The bag is then rotated in order to shift the product toward the corner in which the valve is disposed thereby causing the suspended free end of the sleeve to fold under weight of the product onto itself, to seal the end of the sleeve. The use of 0.5 mil high density polyethylene for the sleeve permits the use of a starch adhesive for securing the sleeve to the bottom panels thereby eliminating the use of latex adhesive heretofore employed for this purpose which was generally unsatisfactory and allowed the sleeve to pull away from the bottom flaps during the filling process.

DESCRIPTION OF THE DRAWINGS

In the drawings, which form an integral part of the specification and are to be read in conjunction therewith, and in which like components are designated by like reference numerals in the various views.

DETAILED DESCRIPTION OF THE INVENTION

Figures 1, 2:
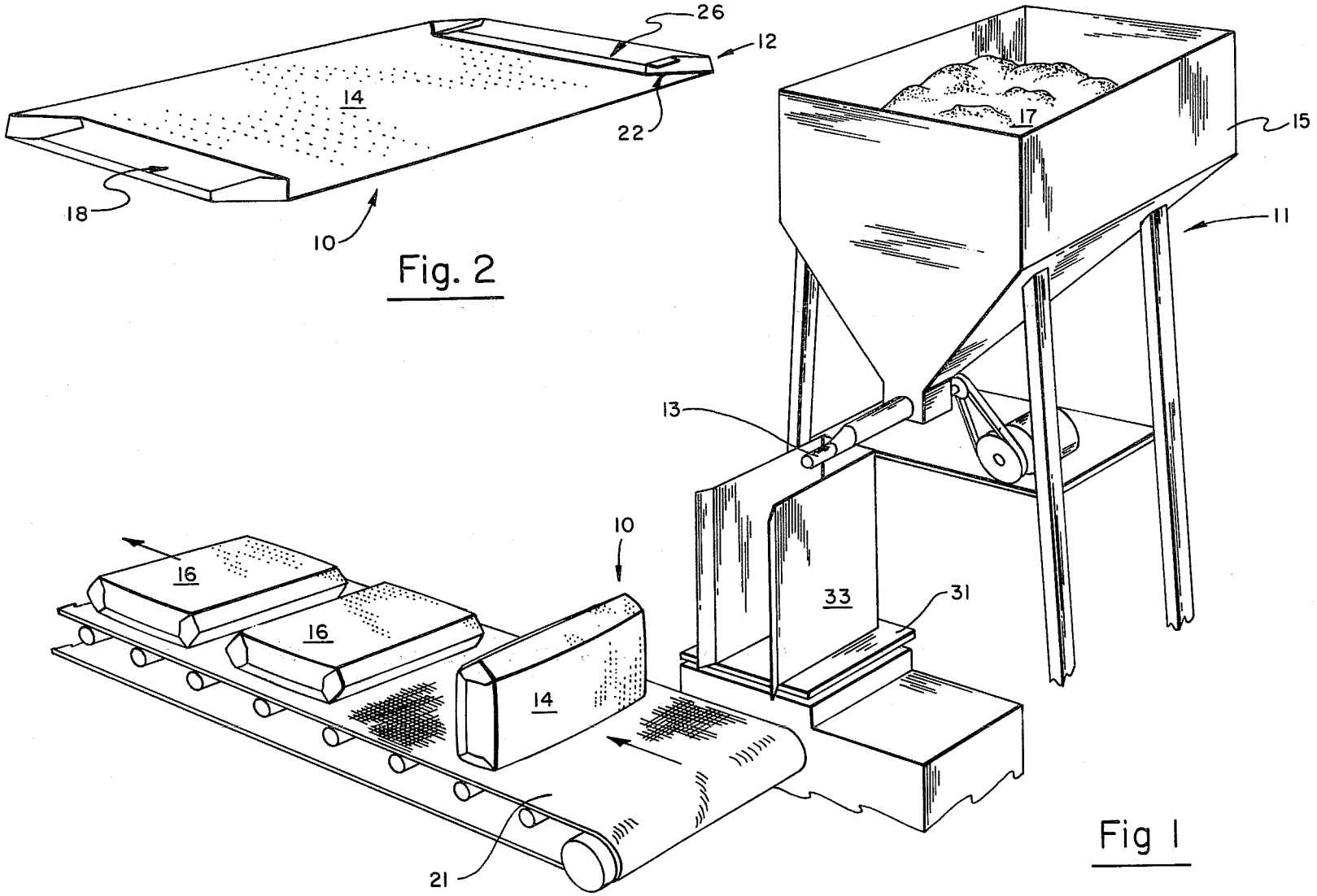
FIG. 1 is a perspective view of an apparatus for filling and manipulating the bag of the present invention.
FIG. 2 is a perspective view of the bag shown in FIG. 1, prior to filling thereof, and in a flattened collapsed condition.
Figures 3, 4:
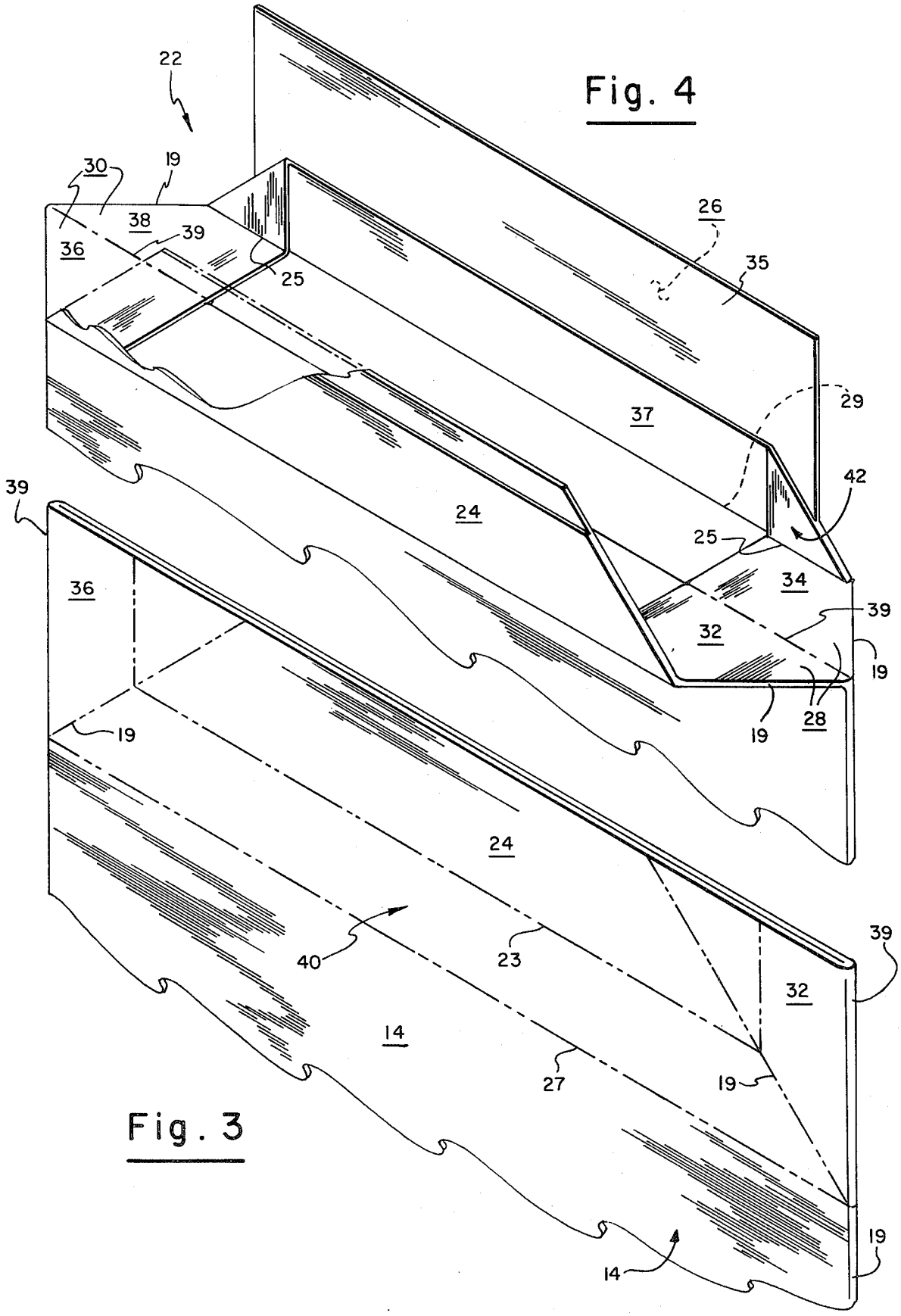
FIGS. 3 and 4 are fragmentary, perspective views of one end of the bag of FIG. 1, showing the steps of folding the bag to enclose the ends thereof.
Figure 6:
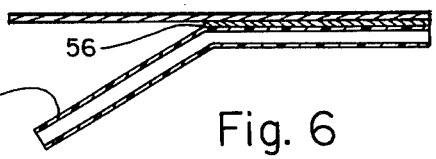
FIG. 6 is a sectional view taken along the line 6—6 in FIG. 5.
Figure 5:
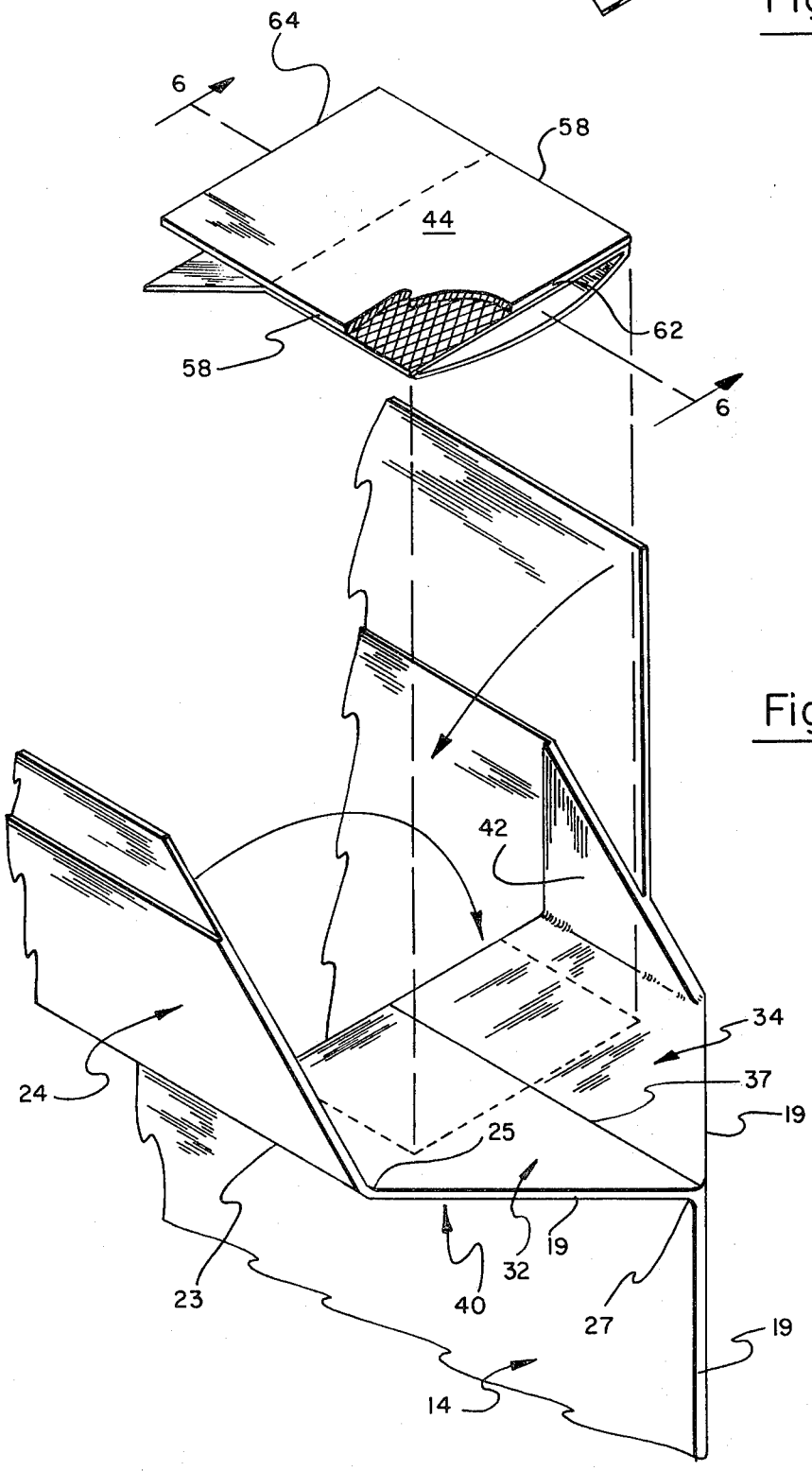
FIG. 5 is a fragmentary, exploded view of one corner of the bag of FIG. 1, having the improved sleeve valve therein.
Figure 7:
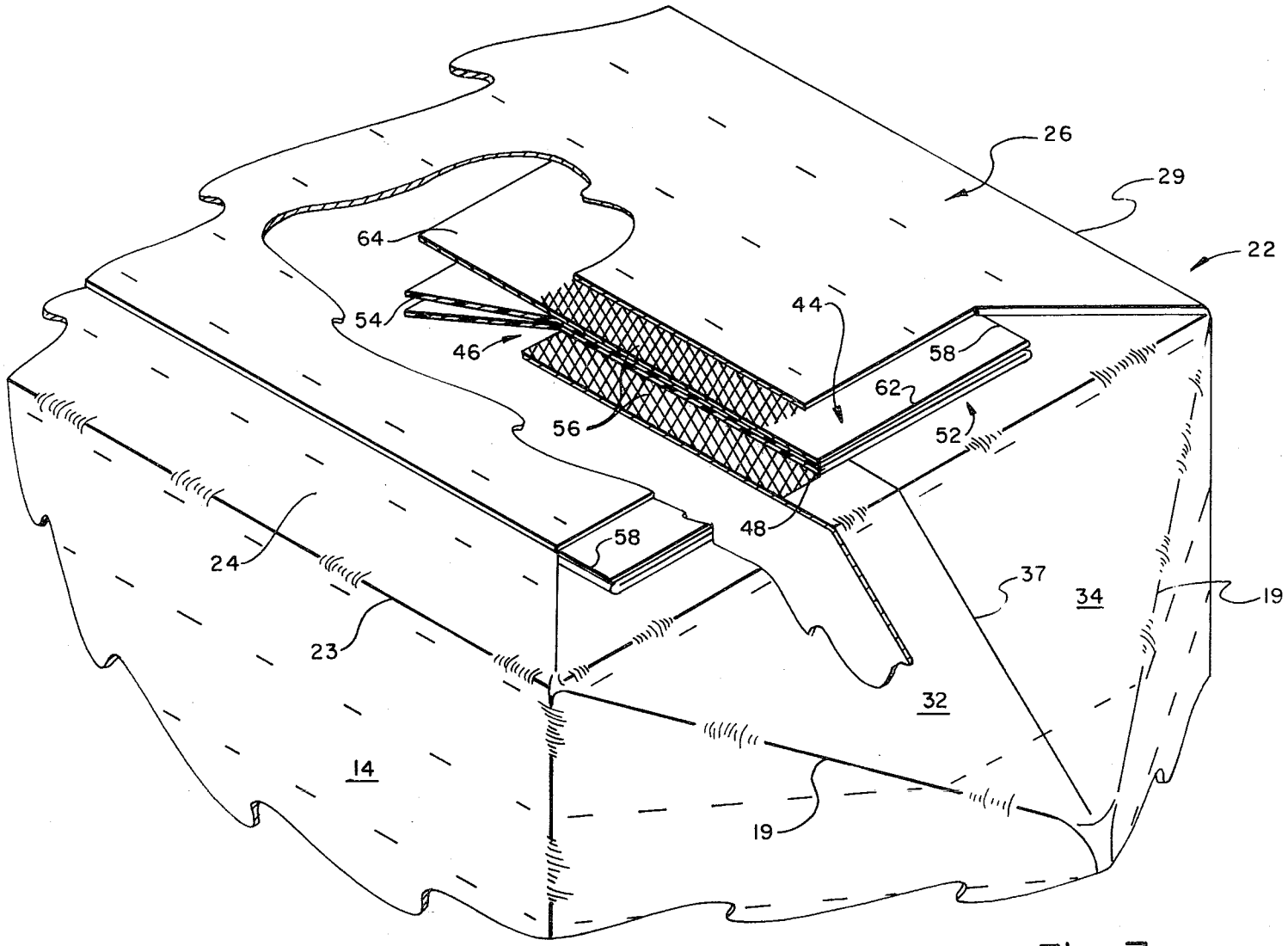
FIG. 7 is a fragmentary, perspective view of one end of the bag of FIG. 1 having the sleeve valve therein, parts being broken away to more clearly show the sleeve valve in a collapsed condition.

Referring now to the drawings, the present invention relates to an improved valve for a flexible bag, generally indicated by the numeral 10, having a filler opening 12 therein which is adapted to receive a dispensing spout 13 of a dispensing machine 11 therein. Dispensing machine 11 is provided with a source 15 of a flowable, fine powdery, small sized granular product 17, and is adapted to deliver the product 17 from the source 15 thereof through the dispensing spout 13, in a metered amount, to the bag 10. The dispensing machine 11 is conventional in design and forms no part of the present invention. Those skilled in the art will appreciate, however, that the machine 11 will include mechanism such as an auger (not shown) for delivering a premeasured amount of the product 17 to the bag 10. A platform 31 disposed beneath the spout 13 has supporting structure 33 mounted thereon for supporting one of the bags 10 in a vertical position during the filling operation. The product 17 may comprise any flowable product including dusty materials such as grain, fertilizer, cement and similar materials.

Preferably, the dispensing spout 13 extends well into the filler opening 12 and forms a relatively tight seal at the filler opening 12 to prevent the escape of product into the surrounding atmosphere during the filling operation. After the bag 10 is filled with product, mechanism (not shown) for positioning and manipulating the bag 10 removes the bag from the dispensing machine 11 and transports the same by conveyor means 21 or the like to subsequent packaging operations.

The bag 10 may be constructed of heavy weight kraft paper or the like, and may be of multiple thickness. As disclosed in the drawings, the bag 10 comprises a triple thickness of kraft paper. The bag 10 includes a front wall 14 and rear wall 16 joined along mutual edges by corresponding fold lines 19 to form a tubular construction. The bottom 18 of the bag 10 is enclosed by a plurality of conventional flap members hingedly interconnected and hingedly joined to the front wall 14 by a fold line 20 which permits pivoting of the bottom 18 along such fold line 20 into an essentially flat condition parallel to the front and rear walls 14 and 16, as shown in FIG. 2.

The top 22 of the bag 10 is essentially enclosed by a first and second closure flap 24 and 26 respectively, in addition to first and second end flaps 28 and 30 respectively. End flap 28 comprises a pair of trapezoidally shaped segments 32 and 34 hingedly connected by a fold line 39, one extremity of the fold line 39 forming a juncture with one end of the fold line 19. Similarly, the second end flap 30 comprises a pair of trapezoidally shaped segments 36 and 38 hingedly interconnected by a fold line 39; one end of fold line 39 forms a juncture with the fold line 19. The outer lateral edges of each of the first and second end flaps 28 and 30 form oblique edges with respect to the fold lines 19 and are hingedly connected by fold lines to the corresponding front and rear walls 14 and 16. End flaps 28 and 30 extend from the lateral extremities of the bag 10 adjacent the fold lines 19 to spaced apart points along the top 22. Top closure flap 24 is trapezoidal in shape and has one edge thereof hingedly connected by a fold line 23 to a folding flap 40. Flap 24 is folded into overlapping relationship to each of the end flaps 28 and 30 and is hingedly connected to each of the latter by virtue of spaced fold lines 25. Folding flap 40 is in turn hingedly connected by a transversely extending fold line 27 to the front wall 14.

Closure flap 26, like closure flap 24, is of triple paper thickness, the outer two layers 35 of flap 26 being rectangular in shape, the inner most layer 37 thereof being essentially trapezoidal. One edge of closure flap 26 is hingedly connected to the rear wall 16 by a transversely extending fold line 29. Flap 26 is secured in overlapping relationship to flaps 24, 28 and 30 by an adhesive applied between the inner of flap 26 and the outer faces of flaps 24 and 30. Closure flap 26 is hingedly connected to the end flaps 28 and 30 by tuck flaps 42 which are interposed between end flaps 28 and 30, and the inner face of closure flap 26.

One corner of the top 22 of bag 10 is provided with a sleeve valve 48 therein disposed within the filler opening 12. Sleeve valve 48 comprises a tubular, plastic sleeve 46 formed from sheet polyethylene plastic preferably having a thickness of 0.5 mil and being of the high density type, most preferably a so-called tubular high density polyethylene. Plastic sleeve 46 is disposed within the filler opening 12 which is defined by a passageway 60 between the inner faces of closure flaps 24 and 26, and the outer face of end flap 28. One side of the plastic sleeve 46 is bonded by an adhesive 56 to the inner face of a rectangularly shaped backing panel 44, and is essentially longitudinally coextensive with the latter. The adhesive 56 used in connection with the preferred form of the invention comprises one of the starch type. One extremity 52 of the opposite side of plastic sleeve 46 is secured by the adhesive 56 to the outer face of end flap 28. The opposite lateral sides of both the plastic sleeve 46 and backing panel 44 are spaced inwardly from the adjacent edges of end flap 28 defined by the fold lines 25. The closure flaps 24 and 26 are adhesively secured to the upper face of backing panel 44 as well as to the upper face of inner flap 28 between fold lines 25 and the lateral edges of backing panel 44; from the foregoing then, it can be appreciated that an essentially air tight seal is formed surrounding the plastic sleeve 46.

One extremity 62 of the backing panel 44 extends laterally outward beyond the outer lateral edges of the closure flaps 24 and 26, while the opposite extremity 64 thereof extends inwardly beyond the inward most edge of end flap 28. Extremity 54 of plastic sleeve 46 likewise extends beyond the innermost edge of end flap 28 and is centrally disposed in suspended relationship within the bag 10, between the fold lines 19.

Prior to use, the bag 10 may be collapsed to an essentially flat state by pivoting the bottom 18 and top 22 about the corresponding fold lines 29 and 27, in which case closure flaps 24 and 26 are flattened against the backing panel 44 and end flap 28 causing collapse of the plastic sleeve 46.

Figure 9:
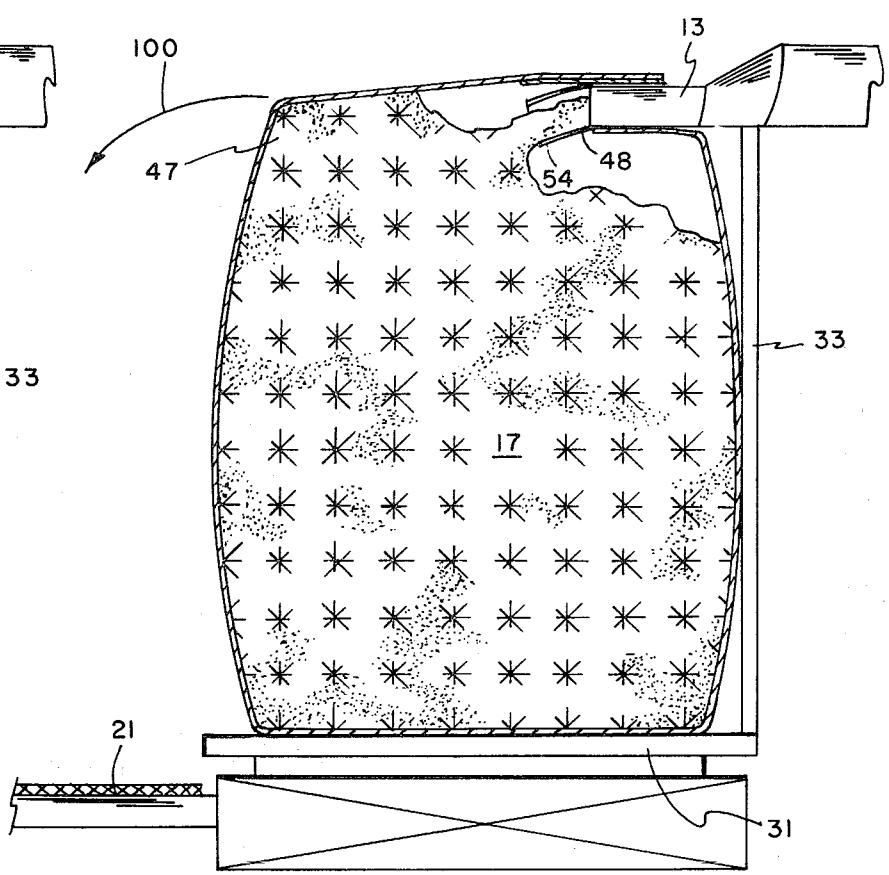
FIGS. 8 and 9 show the bag of FIG. 1 in operative relationship to the dispensing machine during different stages of the filling process.
Figure 8:
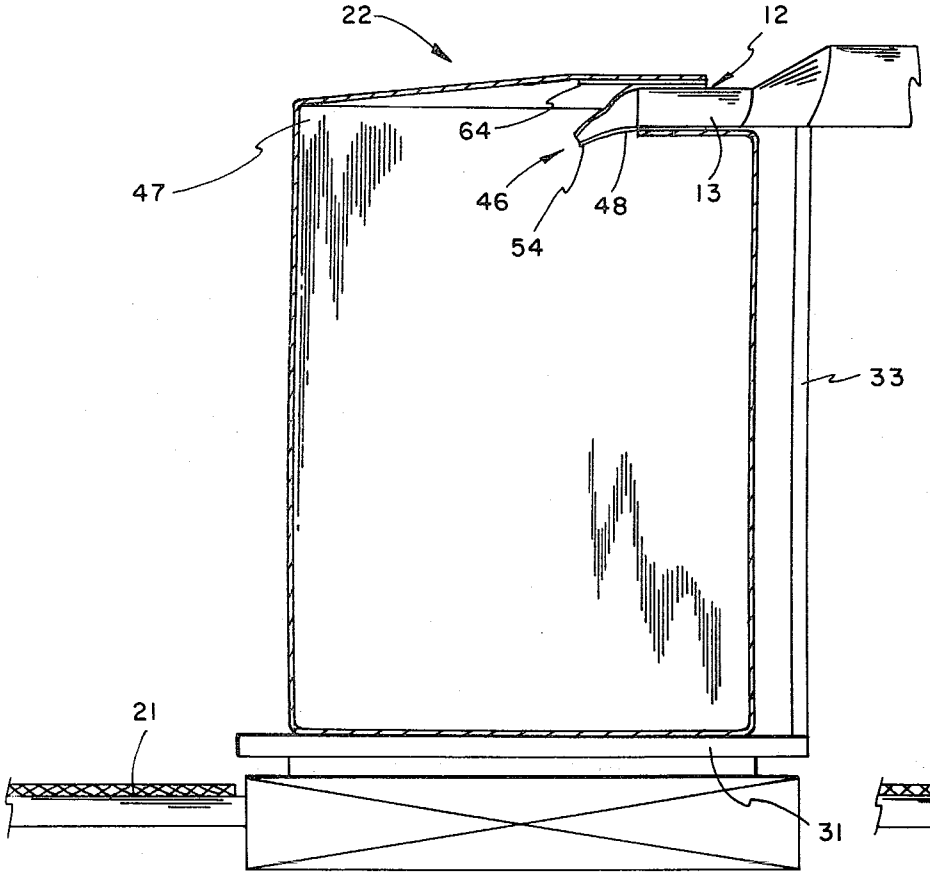
Figure 11:
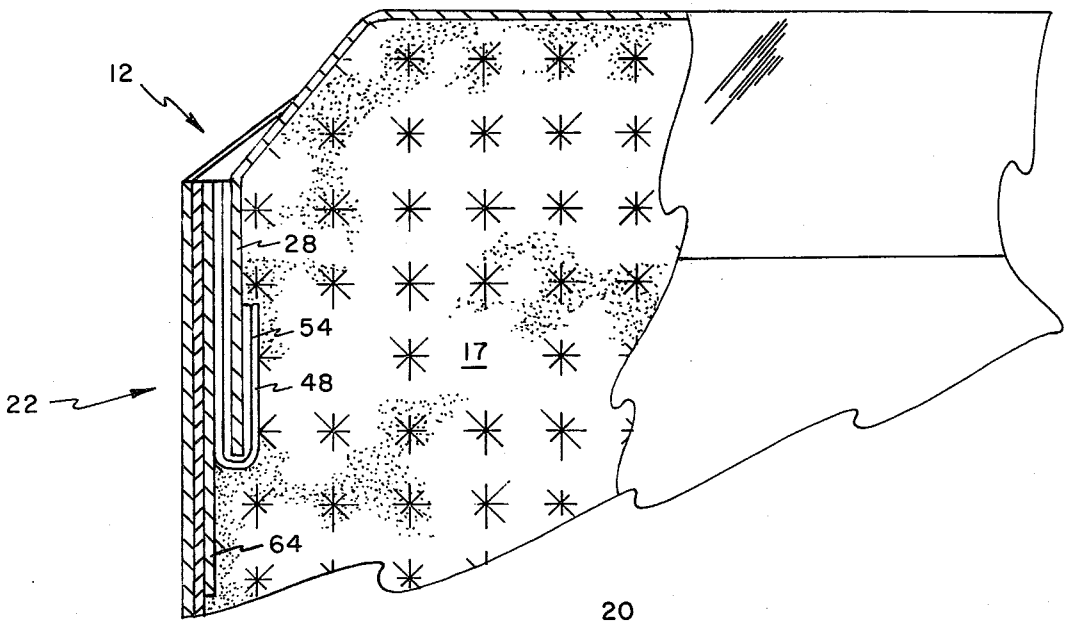
FIG. 11 is a fragmentary, sectional view taken along the line 11—11 in FIG. 10.

When ready for use, the bag 10 is connected to the dispensing machine 11 by pivoting the closure flaps 24 and 26 upwardly about the corresponding fold lines 23 and 29, therebypivoting the segments 32 and 34 of end flap 28 upwardly and toward each other about fold line 39. This expansion of the top 22 of the bag 10 opens the extremity 52 of the plastic sleeve 46 to allow insertion therewithin of the dispensing spout 13. At this point, the ends of the bag 10 are disposed essentially horizontal as best seen in FIGS. 8 and 9. As product 17 flows through the plastic sleeve 48, the free, suspended extremity 54 acts as a self-sealing valve to prevent dusty components of the product 17 within the bag 10 from escaping through the sleeve valve 48. Moreover, because of the essentially air tight adhesive bond between the outside surfaces of the plastic sleeve 46 within the passageway 60 and the surrounding flaps, dusty products 17 are prevented from escaping from the bag around the plastic sleeve 48. Wrinkling of the plastic sleeve 46, heretofore a problem with prior art sleeve valves, is eliminated by virtue of the fact that the plastic sleeve 46 is secured only at the extremity 52 thereof within the passageway 60 while the opposite extremity 54 thereof is freely suspended and thus automatically "irons out" any tendency for wrinkling therein as the suspended extremity of the plastic sleeve expands and contracts as the product 17 flows therethrough.

Figure 10:
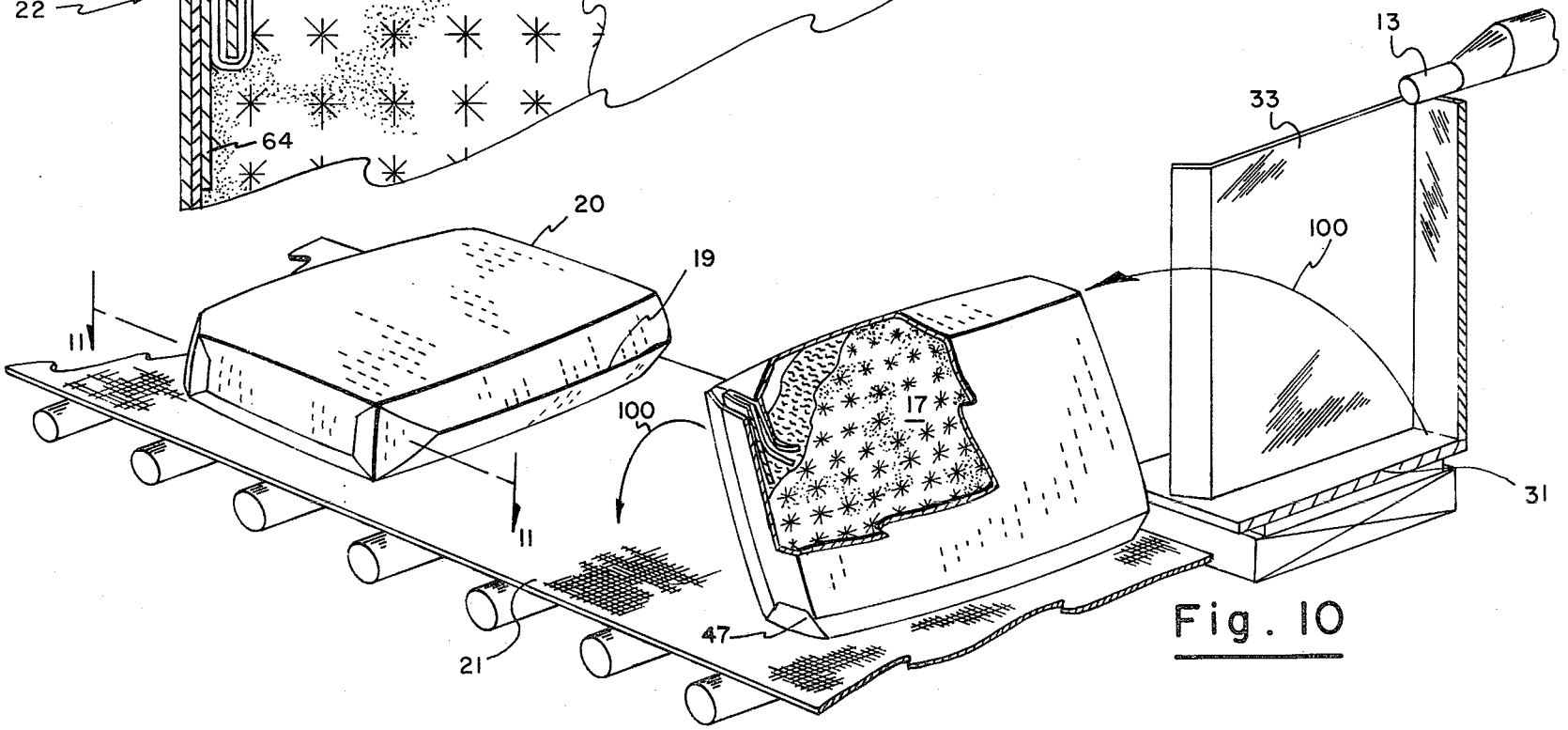
FIG. 10 shows a pair of the bags of FIG. 1, each after having been filled with product, one of the bags having been tilted onto one edge thereof, the other bag having been pivoted onto its side.

After being filled to the desired level, the bag 10 is drawn away from the dispensing spout 13 and is tilted 90 degrees in the direction of the arrow 100 onto one edge thereof as shown in FIG. 10, in order to shift the product 17 within the bag toward the corner 47 thereof. After having been tilted off of the platform 31 onto the conveyor 21, the bag 10 is then rolled over onto one of its sides (front or rear wall 14 and 16), causing the product 17 to shift toward the corner of the bag 10 in which the sleeve valve 48 is disposed. As the product shifts back toward the sleeve valve 48, the free outer extremity 54 of plastic sleeve 46 is forced by the shifting product to fold 90° onto itself and into underlapping relationship to the interior face of end flap 28, thereby effectively sealing the sleeve valve 48 to prevent escape of product therethrough. By virtue of the effective sealing of the plastic sleeve 46 created by folding thereof, the bag 10 may be inverted if desired without risk of escape of the product therefrom.

From the foregoing, it is apparent that the improved sleeve of the present invention not only provides for the reliable accomplishment of the objects of the invention but does so in a particularly effective and economical manner. It is recognized, of course, that those skilled in the art may make various modifications or additions to the preferred embodiment chosen to illustrate the invention without departing from the spirit and scope thereof. Accordingly, it is to be understood that the protection sought and to be afforded hereby should be deemed to extend to the subject matter claimed and all equivalents thereof fairly within the scope of the invention.

What is claimed is:

1. A bag comprising:

a flexible tube adapted to contain a flowable product therein, said tube having first and second opposed ends, said first end of said tube being closed, said second end of said tube having a filler opening therein through which said flowable product may be delivered into said bag, said tube including a first and second flap overlapping each other on said second end thereof; and a flexible, elongated sleeve valve extending through said opening, said sleeve valve having first and second extremities, said first extremity being disposed within said opening being interposed between said first and second flaps, and said second extremity extending into the interior of said tube and freely suspended within said interior of said tube.

2. The bag of claim 1, wherein the entire periphery of said first extremity of said sleeve valve is secured to said tube in a manner to form an essentially air tight seal between said tube and said sleeve valve.

3. The bag of claim 2 wherein:

said tube comprises paper, and said sleeve valve comprises plastic material, said plastic material being bonded to said tube.

4. The bag of claim 3, wherein said plastic material comprises sheet polyethylene having a thickness of approximately 0.5 mil.

5. The bag of claim 4, wherein said sheet polyethylene is of high density.

6. The bag of claim 1, wherein at least one of said first and second flaps is hingedly connected to the side walls of said tube at one corner of said tube, said opening being disposed adjacent said one corner.

7. The bag of claim 1, further including a panel member bonded to one side of said sleeve valve and interposed between said sleeve valve and one of said first and second flaps.

8. The bag of claim 7, wherein a pair of opposite edges of said panel member extend laterally outward beyond opposing lateral edges of said sleeve valve.

9. The bag of claim 1 wherein said sleeve valve is tubular in shape.

10. The bag of claim 9, wherein said first and second bottom flaps define an elongate passageway in said second end of said tube, said opening forming a part of said passageway.

11. The bag of claim 10, wherein one of said first and second bottom flaps includes first and second sections hingedly connected together by a fold line.

* * * * *